United States Patent [19]

Quick et al.

[11] Patent Number: 4,649,825

[45] Date of Patent: Mar. 17, 1987

[54] EXPLOSIVE SEPARATION SYSTEM FOR COMPOSITE MATERIALS

[75] Inventors: Wilson M. Quick, Santa Cruz; Richard G. Hallmark, San Jose, both of Calif.

[73] Assignee: The United States of America as represented by the Secretary of the Navy, Washington, D.C.

[21] Appl. No.: 624,482

[22] Filed: Jun. 25, 1984

[51] Int. Cl.[4] ..... F42B 1/02

[52] U.S. Cl. ..... 102/307; 102/309; 102/310; 102/321; 102/331; 102/324; 102/332; 102/476

[58] Field of Search ..... 102/307, 310, 476, 321, 102/331, 332, 309, 324

[56] References Cited

U.S. PATENT DOCUMENTS

| | | | |
|---|---|---|---|
| 2,605,704 | 8/1952 | Dumas | 102/307 |
| 3,169,479 | 2/1965 | Bryan | 102/307 |
| 3,180,264 | 4/1965 | Webb | 102/307 X |
| 3,185,089 | 5/1965 | Parkhurst et al. | 102/307 |
| 3,185,090 | 5/1965 | Weber | 102/24 |
| 3,311,324 | 3/1967 | Holt et al. | 102/307 X |
| 3,336,868 | 8/1967 | Rush et al. | 102/307 X |
| 3,919,939 | 11/1975 | Murry et al. | 102/72 |
| 3,971,290 | 7/1976 | Blain | 89/1 B |
| 4,126,092 | 11/1978 | Cross | 102/24 HC |
| 4,148,257 | 4/1979 | Orrill et al. | 102/24 HC |
| 4,151,798 | 5/1979 | Ridgeway | 102/24 HC |
| 4,222,329 | 9/1980 | Austin | 102/24 HC |
| 4,244,104 | 4/1980 | Mills et al. | 102/49 |
| 4,327,642 | 5/1982 | Grosse-Benne et al. | 102/307 |
| 4,348,957 | 9/1982 | White et al. | 102/378 |
| 4,359,943 | 11/1982 | Majerus | 102/307 X |
| 4,407,468 | 10/1983 | Bement et al. | 244/137 P |
| 4,430,939 | 2/1984 | Harrold | 102/308 X |

*Primary Examiner*—Peter A. Nelson

*Attorney, Agent, or Firm*—R. F. Beers; C. D. B. Curry; W. C. Daubenspeck

[57] ABSTRACT

An explosive separation system for making a clean cut in composite laminate materials in which a flexible linear shaped charge is maintained in a molded holder of a low-density, energy-absorbing material. The flexible linear shaped charge is molded in the holder when the holder itself is molded to ensure correct alignment of the charge and a correct standoff distance from the surface to be cut. The holder has sufficient volume to dissipate reflected explosive forces to reduce secondary damage to the cut edges and to areas adjacent to target area.

12 Claims, 4 Drawing Figures

FIG _ 1
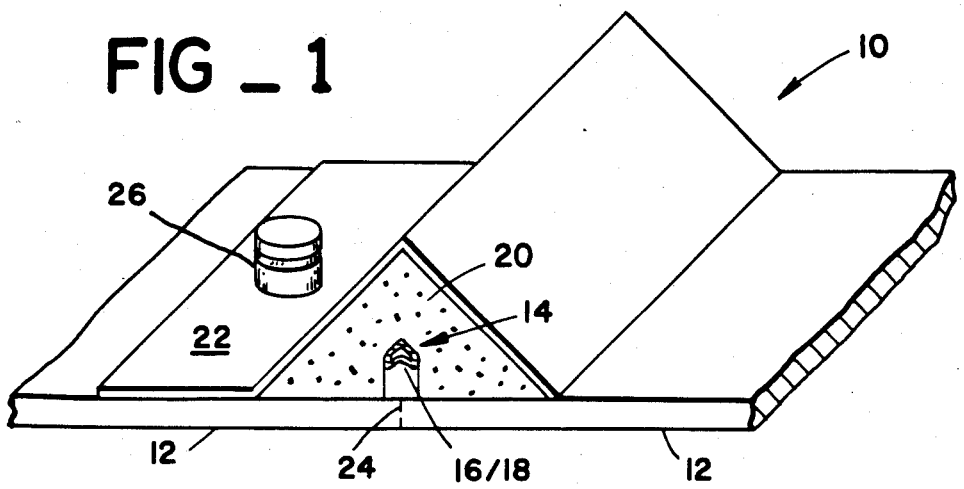
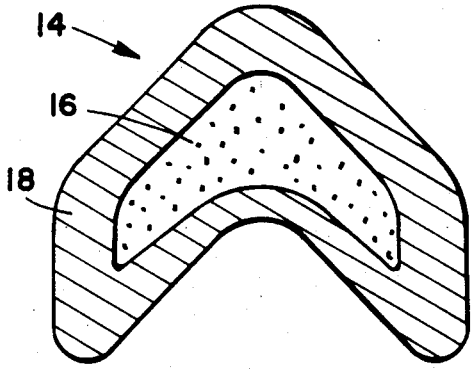
FIG _ 2
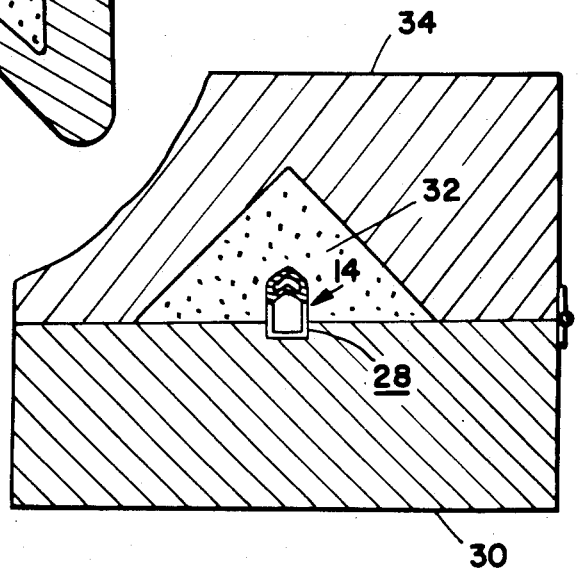
FIG _ 3
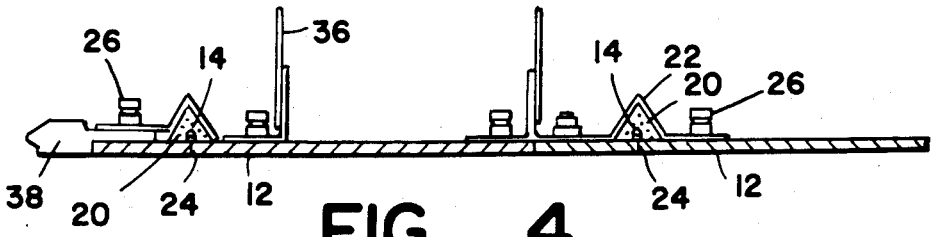
FIG _ 4

EXPLOSIVE SEPARATION SYSTEM FOR COMPOSITE MATERIALS

BACKGROUND OF THE INVENTION

This invention relates in general to explosive separation apparatus and, more particularly, to explosive separation apparatus having general utility but especially suitable for cutting advanced composite materials used in aerospace vehicles.

Missile staging events are usually initiated with separation systems that employ explosive actuators. One commonly used technique is to use a mild detonating fuse (MDF) to severe the missile skin. The goal of this system is to use the pyrotechnic gas pressure and shock generated by detonation of the MDF to physically break the structure apart at some locally machined groove in the missile skin. However, where structural composites such as graphite-epoxy laminates are employed as in the missile skin, weakening grooves cannot be used. One possible solution is to employ additional metallic structure solely for separation purposes, but this imposes an obvious penalty in weight and complexity.

U.S. Pat. No. 3,971,290 discloses a technique for cutting a composite shell directly using an MDF. A primary problem in the explosive cutting of composite shells is that adjacent structures or materials fracture or delaminate. The adove cited U.S. Patent is not entirely satisfactory in eliminating the delamination in areas adjacent to the separation boundry.

A flexible linear shaped charge (FLSC) has advantages over MDF since the FLSC provides highly directional cutting rather than explosive force in all directions as is the case with an MDF. One advantage in the case of aerospace vehicles is that an FLSC may use less explosive which will reduce the amount of shock imparted to the vehicle during the separation event. However, the installation of an FLSC is a problem since it must be oriented precisely or its reliability is reduced. Heretofore explosive separators employing an FLSC have also produced delamination when used to cut composite materials in an aerospace environment. This delamination can be eliminated if the backward forces of the detonation are not closely confined; however, in most circumstances these backward forces will cause unacceptable damage to adjacent structures if not closely confined.

SUMMARY OF THE INVENTION

It is an object of the present invention to provide an improved explosive separation system for use on an aerospace vehicle.

Another object of the present invention is to provide an explosive separation system for cutting composite laminated materials without the delamination or fracture of adjacent material or structures.

Another object of the present invention is to provide an explosive separation system employing a FLSC having ease of installation and providing the necessary exact positioning of the explosive.

A further object is to provide an explosive separation system in which the shock is confined to a small envelope so that sensitive components can be placed closer to the explosive.

In the present invention a FLSC is maintained at the proper orientation to and at the proper standoff distance from the surface to be cut by a holder of a low-density energy-absorbing material such as polyurethane foam. The FLSC is molded into the foam holder when the foam is formed so that a single unit is provided. A backup structure maintains the holder in place and ensures that the products of the explosion are confined within a prescribed envelope. The foam holder dissipates the explosive forces from the detonation of the FLSC which are directed in directions other than at the separation plane. If not absorbed by the energy-absorbing foam holder, these forces will be reflected back toward the surface of the composite material and will cause damage in areas adjacent to the separation plane.

The advantages and features of the present invention will become apparent as the same becomes better understood from the following description of the preferred embodiment when considered in conjunction with the accompanying drawings wherein:

BRIEF DESCRIPTION OF THE DRAWINGS

FIG. 1 is a perspective view in cross-section illustrating a preferred embodiment of the present invention;

FIG. 2 is a cross-sectional view of a flexible linear shaped charge;

FIG. 3 illustrates the preferred method of assembling the FLSC in a holder; and

FIG. 4 is a cross-sectional view of an embodiment of the explosive separator for separating a missile shell.

DESCRIPTION OF THE PREFERRED EMBODIMENT

Referring now to the drawings, FIG. 1 illustrates the explosive separator 10 of the present invention disposed on a target structure 12 such as a missile skin of laminated composite material. The explosive separator 10 includes a flexible linear shaped charge (FLSC) 14 of chevron shaped cross-section. The FLSC 14, as best shown in FIG. 2, has a core 16 of explosive material disposed within a metallic liner 18. The FLSC 14 is disposed in a holder 20 of an energy absorbing material. A backup 22 of metallic or composite material maintains the holder 20 in the proper position over the separation plane 24. The backup 22 is held in place by suitable fastening means such as bolts 26. The backup 22 also serves to prevent flak from being thrown in-board by the separator.

The holder 20 maintains the FLSC 16 at the proper standoff distance from the target structure 12 and in the proper orientation so that the explosive forces are directed toward the separation plane 24. The size and precise shape of the FLSC and the standoff distance are determined by the specific cutting requirements according to well known principles.

The energy-absorbing holder 20 also attenuates the gas and shock pressure and slows the particles which are emitted from the back of the FLSC 14. When the ordinance is tightly confined within a holder 20 of non-energy absorbent material and a backup 22, these back pressure and shock loads are reflected onto the target 12, often causing severe damage to areas of the target adjacent to the separation plane 24. The energy-absorbing holder 20 is therefore made from a material which has a low density ad is compatible with the projected operating environment (i.e. temperature tolerance, shelf life required, etc,). The holder 20 must have a volume sufficient to properly attenuate these reflected loads.

The triangular cross-section of the holder 20 of FIG. 1 is not critical as long as a proper volume is provided to attenuate the reflected energy. A semi-circular cross-section is equally suitable and may be desirable for reasons unrelated to its energy-absorbing function. Low density foam materials such as silicon foam, polyurethane foam, and polyethylene foam are suitable for use as holder 20, depending upon their compatibility with the operating environment.

FIG. 3 illustrates the preferred method of assembling the FLSC 14 and the holder 20. In the preferred method, the FLSC is molded into the foam holder at the same time that the foam itself is molded. The FLSC 14 is mounted on a extruded holder 28 in one section of a mold body 30. The cavity 32 in the other section of the mold body 34 is then filled with the foam forming material. When made in this manner the FLSC 14 and the holder 20 act as a single unit which minimizes the problems associated with installation of the explosive separator and provides exact positioning of the FLSC. The alternative is to form the foam holder 20 separately and attach the FLSC 14 at a later time with an adhesive means. This method generates potential problems in alignment of the FLSC and failure of the adhesive which are not present in the preferred method.

Obviously many modifications and variations of the present invention are possible in the light of the above teachings. It is therefore to be understood that within the scope of the appended claims the invention may be practiced otherwise than as specifically described.

What is claimed is:

1. An explosive separation system for cutting through a missile shell made from composite laminate materials, said separation system cutting through said composite materials along a separation plane without causing delamination or fragmentation in areas of the shell adjacent to said separation plane, which comprises:

(a) a flexible linear shaped charge for providing directional cutting along said separation plane;

(b) a holder made of low-density, energy-absorbing material for holding said flexible linear shaped charge at a desired orientation and at a desired standoff distance from the surface of the missile shell at a region to be cut, (1) said holder having a first surface shaped to be disposed against the surface of the missile shell at the region to be cut, (2) said holder having a channel in said first surface, said channel being located over the separation plane when said first surface is disposed against the surface of the said missile shell at the region to be cut, (3) said channel having a depth and shape to hold said flexible linear shaped charge at the interior end of said channel and at the desired orientation and the desired standoff distance from the surface to be cut, and (4) said holder having sufficient volume to absorb the energy of the flexible linear shaped charge that is directed in directions other than toward the missile shell through said channel so that reflected products of the detonation of said flexible linear shaped charge do not strike the surface of the missile shell with enough force to damage the cut edges or the surface adjacent to the cut; and (c) means for securing said holder with said first surface being disposed against the surface of the missile shell at the region to be cut with said channel being located over the separation plane.

2. An explosive separation system as recited in claim 1 wherein said holder is essentially triangular in cross-section and said channel is disposed along the center of one side of the holder.

3. An explosive separation system as recited in claim 1 wherein said holder is made from low-density foam.

4. An explosive separation system as recited in claim 3 wherein said foam is polyurethane foam.

5. An explosive separation system as recited in claim 3 wherein said flexible linear shaped charge is fixed in said foam holder when said holder is formed.

6. An explosive separation system as recited in claim 1 wherein said means for securing said holder against the surface of the missile shell includes a backup layer covering the surface of said holder except for said first surface, said backup layer confining products of the detonation of the flexible linear shaped charge.

7. An explosive separation system for cutting through a shell made from composite laminate materials, said separation system cutting through said composite materials along a separation plane without causing delamination or fragmentation in areas of shell adjacent to said separation plane, which comprises:

(a) a flexible linear shaped charge for providing directional cutting along said separation plane;

(b) a holder made of low-density, energy-absorbing material for holding said flexible linear shaped charge at a desired orientation and at a desired standoff distance from the surface of the shell at a region to be cut, (1) said holder having a first surface shaped to be disposed against the surface of the shell at the region to be cut, (2) said holder having a channel in said first surface, said channel being located over the separation plane when said first surface is disposed against the surface of the said shell at the region to be cut, (3) said channel having a depth and shape to hold said flexible linear shaped charge to the interior end of said channel and at the desired orientation and the desired standoff distance from the surface to be cut, and (4) said holder having sufficient volume to absorb the energy of the flexible linear shaped charge that is directed in directions other than toward the shell through said channel so that reflected products of the detonation of said flexible linear shaped charge do not strike the surface of the shell with enough force to damage the cut edges or the surface adjacent to the cut; and (c) means for securing said holder with said first surface being disposed against the surface of the shell at the region to be cut with said channel being located over the separation plane.

8. An explosive separation system as recited in claim 7 wherein said holder is essentially triangular in cross-section and said channel is disposed along the center of one side of the holder.

9. An explosive separation system as recited in claim 7 wherein said holder is made from low-density foam.

10. An explosive separation system as recited in claim 9 wherein said foam is polyurethane foam.

11. An explosive separation system as recited in claim 9 wherein said flexible linear shaped charge is fixed in said foam holder when said holder is formed.

12. An explosive separation system as recited in claim 7 wherein said means for securing said holder against the surface of the shell includes a backup layer covering the surface of said holder except for said first surface, said backup layer confining products of the detonation of the flexible linear shaped charge.

* * * * *